US008657426B2

(12) United States Patent
Hoff

(10) Patent No.: US 8,657,426 B2
(45) Date of Patent: Feb. 25, 2014

(54) SEAL AND SEAL PULLING MEMBER FOR INK TANK

(75) Inventor: Joseph W. Hoff, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 9 days.

(21) Appl. No.: 13/359,746

(22) Filed: Jan. 27, 2012

(65) Prior Publication Data

US 2013/0194355 A1 Aug. 1, 2013

(51) Int. Cl.
*B41J 2/175* (2006.01)

(52) U.S. Cl.
USPC ..... 347/86

(58) Field of Classification Search
USPC ..... 347/85, 86, 87
See application file for complete search history.

(56) References Cited

U.S. PATENT DOCUMENTS

| | | | | |
|---|---|---|---|---|
| 5,777,646 | A * | 7/1998 | Barinaga et al. | 347/86 |
| 5,831,652 | A | 11/1998 | Hinami et al. | |
| 6,102,533 | A * | 8/2000 | Nozawa et al. | 347/86 |
| 6,155,678 | A * | 12/2000 | Komplin et al. | 347/86 |
| 6,464,339 | B1 * | 10/2002 | Ardito | 347/49 |
| 6,474,799 | B1 * | 11/2002 | Shimada et al. | 347/86 |
| 6,871,944 | B2 * | 3/2005 | Kobayashi et al. | 347/86 |
| 7,350,902 | B2 | 4/2008 | Dietl et al. | |
| 8,042,925 | B2 * | 10/2011 | Sugahara et al. | 347/86 |

* cited by examiner

*Primary Examiner* — Anh T. N. Vo
(74) *Attorney, Agent, or Firm* — Peyton C. Watkins

(57) ABSTRACT

An ink tank that is mountable to a printhead, the ink tank includes a tank body including a first wall including an ink outlet configured to supply ink to the printhead; a slider guide disposed on an exterior surface of the tank body, wherein the slider guide is proximate the first wall; and an ink reservoir including interior surfaces of the tank body; and a film that is adhered to a sealing area surrounding the ink outlet.

21 Claims, 18 Drawing Sheets

SEAL AND SEAL PULLING MEMBER FOR INK TANK

CROSS REFERENCE TO RELATED APPLICATION

Reference is made to commonly assigned, co-pending U.S. patent application Ser. No. 13/359,762, filed Jan. 27, 2012, entitled "Seal and Secondary Film for Ink Tank" by Joseph Hoff, the disclosure of which is herein incorporated by reference.

FIELD OF THE INVENTION

The present invention relates generally to the field of ink tanks for inkjet printheads, and more particularly to a seal that is removed from the ink tank before the ink tank is installed on the printhead.

BACKGROUND OF THE INVENTION

An inkjet printer typically includes one or more printheads and their corresponding ink supplies. A printhead includes an array of drop ejectors, each ejector includes an ink chamber, an ejecting actuator and a nozzle through which droplets of ink are ejected. The ejecting actuator may be one of various types, including a heater that vaporizes some of the ink in the chamber in order to propel a droplet out of the nozzle, or a piezoelectric device which changes the wall geometry of the chamber in order to produce a pressure wave that ejects a droplet. The droplets are typically directed toward paper or other recording medium in order to produce an image according to image data that is converted into electronic firing pulses for the drop ejectors as the print medium is moved relative to the printhead.

Ink is provided to the printhead through an inlet port of the printhead. In some printers the corresponding ink supply can be located remotely from the printhead and connected to it, for example by tubing. Alternatively in other printers, an ink supply, also called an ink tank or ink reservoir, can be directly coupled to the printhead. For the case of ink tanks mounted on the carriage of a carriage printer, the ink tank can be permanently mounted onto the printhead, so that the printhead needs to be replaced when the ink is depleted, or the ink tank can be detachably mounted onto the printhead, so that only the ink tank itself needs to be replaced when the ink tank is depleted. Carriage mounted ink tanks typically contain only enough ink for up to about several hundred prints. This is because the total mass of the carriage needs be limited, so that accelerations of the carriage at each end of the travel do not result in large forces that can shake the printer back and forth. As a result, users of carriage printers having detachably mounted ink tanks need to replace the ink tanks periodically, depending on their printing usage, typically several times per year. An ink tank design facilitating easy and clean installation of a detachable ink tank is beneficial.

Inkjet ink includes a variety of volatile and nonvolatile components including pigments or dyes, humectants, image durability enhancers, and carriers or solvents. For proper operation of the inkjet printhead, it is important that the ink transferred from the outlet port of the ink tank to the inlet port of the printhead have the appropriate balance of these ink components. Therefore, during shipping and storage of an inkjet ink tank it is common practice to provide a seal over the outlet port(s) of the ink tank in order to inhibit the evaporative loss of the volatile components of the ink. U.S. Pat. No. 6,464,339 discloses a removable seal that is adhesively attached over the outlet port of an ink tank.

A problem that can occur when removing a seal that is adhered around the outlet port is that it can be difficult for the user to remove the seal in a controllable fashion. Particularly if the seal is removed rapidly, as the seal is removed, a sticking of the seal and then sudden release as it is pulled off can cause ink on the seal to be flung off. The ink spatter can get on the user's hands or clothing.

Consequently, a need exists for an ink tank that facilitates easy and clean removal of the seal prior to installation onto the printhead.

SUMMARY OF THE INVENTION

The present invention is directed to overcoming one or more of the problems set forth above. Briefly summarized, according to one aspect of the invention, the invention resides in an ink tank that is mountable to a printhead, the ink tank comprising a tank body including a first wall including an ink outlet configured to supply ink to the printhead; a slider guide disposed on an exterior surface of the tank body, wherein the slider guide is proximate the first wall; and an ink reservoir including interior surfaces of the tank body; and a film that is adhered to a sealing area surrounding the ink outlet.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

Figure 1:
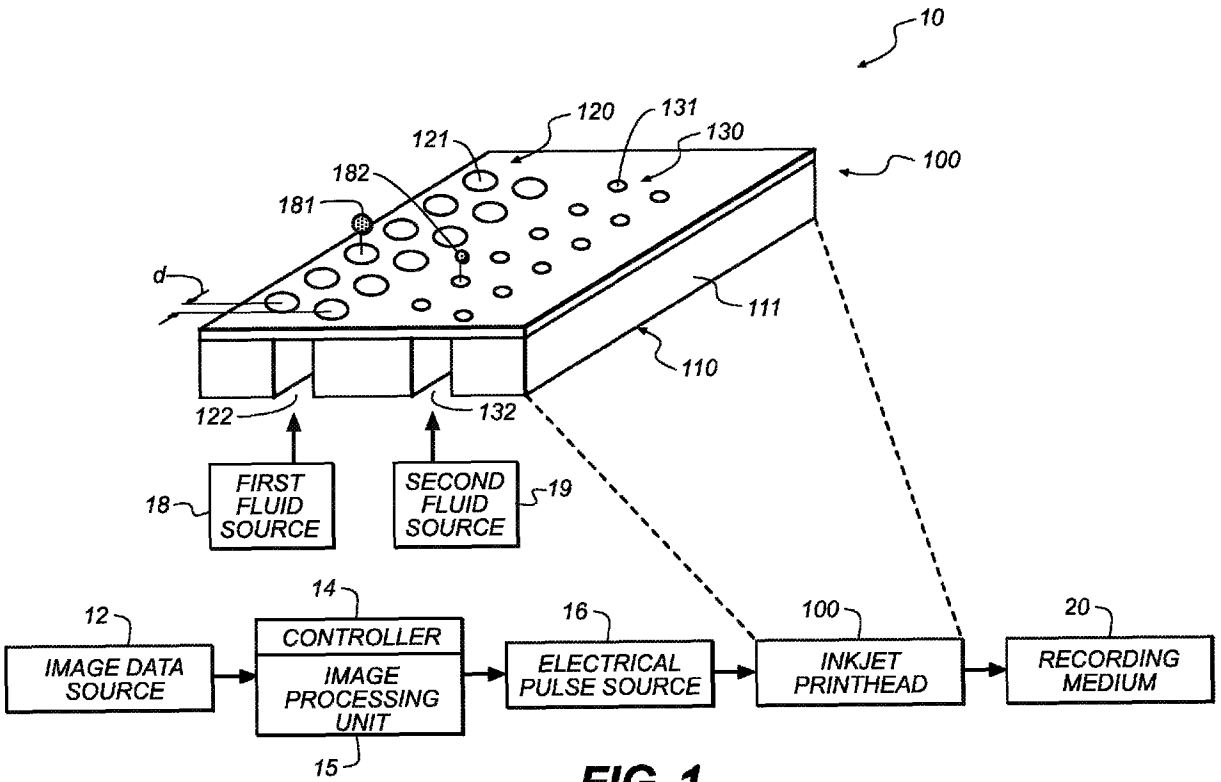
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays 120, 130 has two staggered rows of nozzles 121, 131, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles 121, 131 from one row of an array would print the odd numbered pixels, while the nozzles 121, 131 from the other row of the nozzle array 120, 130 would print the even numbered pixels.

In fluid communication with each nozzle array 120, 130 is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die 110 are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays 120, 130 can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles 121, 131. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
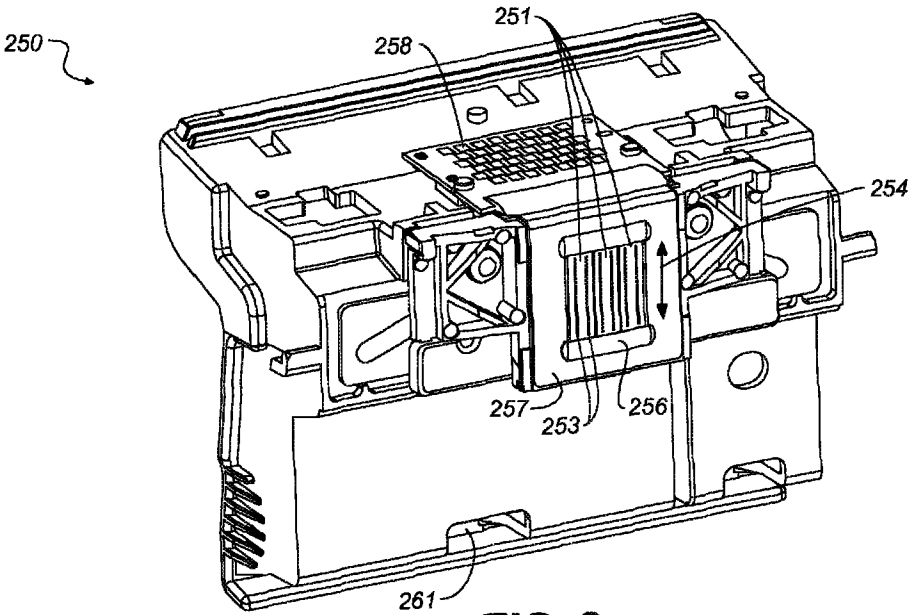
FIG. 2 is a perspective of a portion of a printhead.

FIG. 2 shows a bottom perspective of a portion of a printhead 250, which is an example of an inkjet printhead 100. Printhead 250 includes three printhead die 251 (similar to printhead die 110 in FIG. 1), each printhead die 251 containing two nozzle arrays 253, so that printhead 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array 253 along the nozzle array direction 254 is typically on the order of 1 inch or less. Typical lengths of recording media 20 are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 3), connector board 258 is electrically connected to a connector (not shown) on the carriage 200, so that electrical signals are transmitted to the printhead die 251.

As described below, one or more ink reservoirs (also called ink tanks herein) are detachably mountable in printhead 250. In the bottom perspective of FIG. 2, a ledge on printhead 250 is provided as a catch 261 to engage with a latch on an ink tank (not shown in FIG. 2). When catch 261 is engaged with the latch on an ink tank, the ink tank is held in its mounted position.

Figure 3:
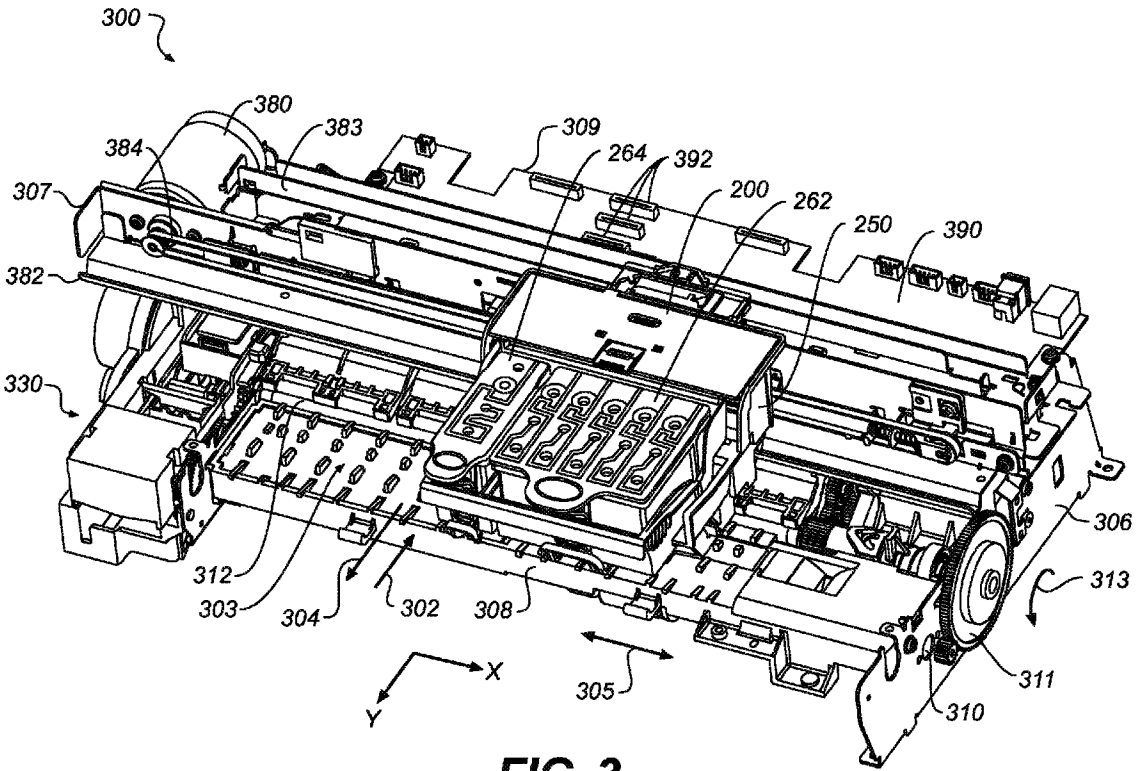
FIG. 3 is a perspective of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink tank 262 and single-chamber ink tank 264 are mounted in the printhead 250. When the ink tanks 262 and 264 are mounted in the printhead 250, as in FIG. 3, the combined assembly of printhead 250 and ink tanks 262 and 264 is called an inkjet printhead assembly. The mounting orientation of printhead 250 is rotated relative to the view in FIG. 2, so that the printhead die 251 are located at the bottom side of printhead 250, the droplets of ink ejected downward onto the recording medium 20 in print region 303 in the view of FIG. 3. Multi-chamber ink tank 262, in this example, contains five ink sources: cyan, magenta, yellow, photo black, and colorless protective fluid; while single-chamber ink tank 264 contains the ink source for text black. Paper or other recording medium 20(sometimes generically referred to as paper or media herein) is loaded along paper load entry direction 302 toward the front of printer chassis 308.

Figure 4:
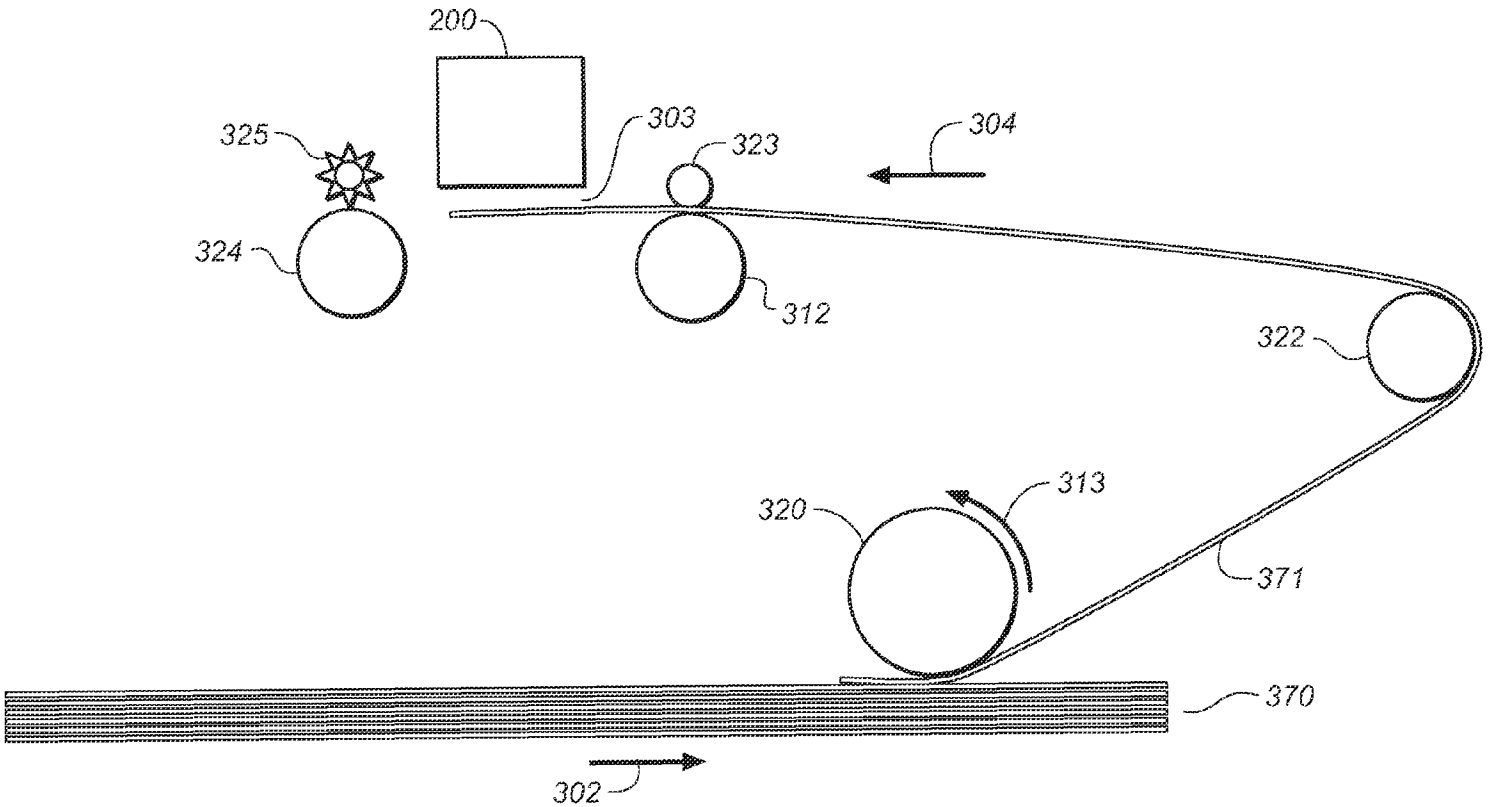
FIG. 4 is a schematic side view of an exemplary paper path in a carriage printer.

A variety of rollers are used to advance the recording medium 20 through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller 312.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead 250. Also on electronics board 390 are typically mounted motor controllers for the carriage motor 380 and for the paper advance motor, a processor andr other control electronics (shown schematically as controller 14 and image processing unit 15 in FIG. 1) for controlling the printing process, and an optional connector for a cable to a host computer.

Figure 5:
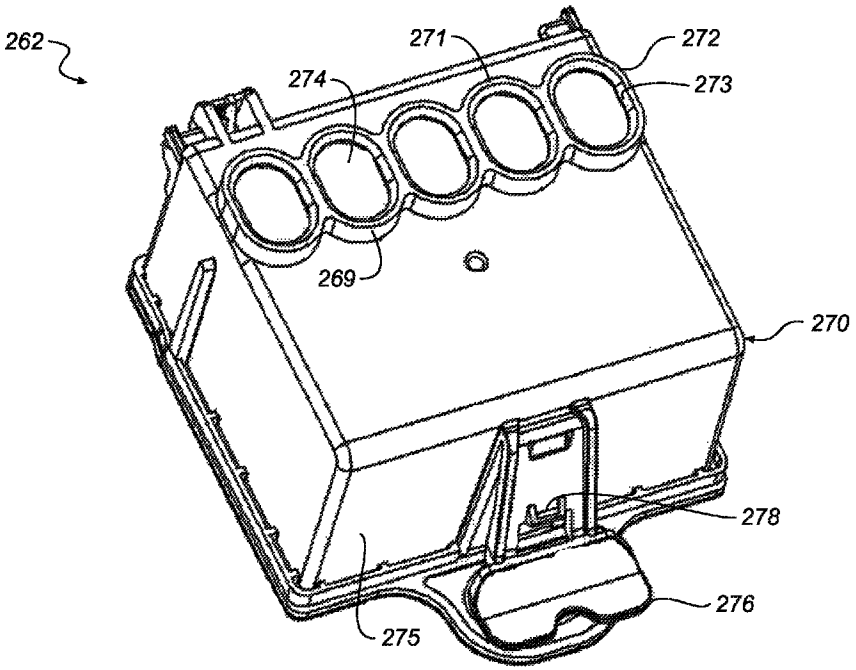
FIG. 5 is a bottom perspective of a multi-chamber ink tank.
Figure 6:
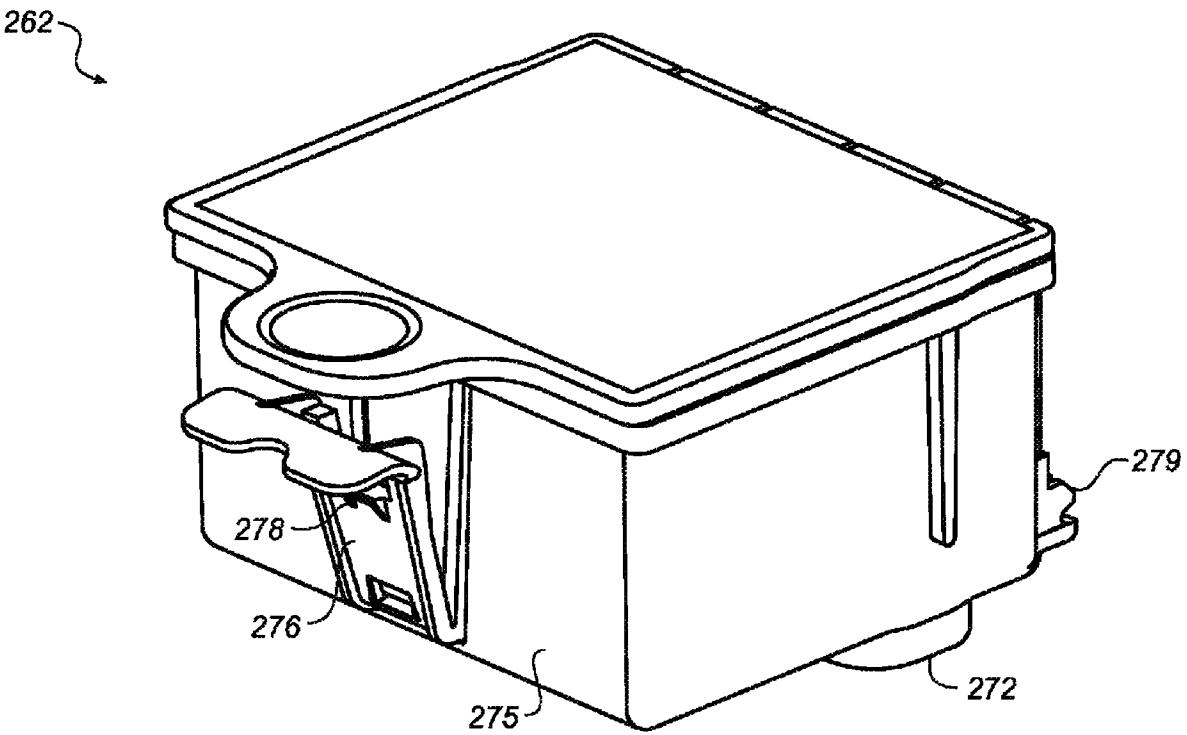
FIG. 6 is a top perspective of a multi-chamber ink tank.

FIG. 5 shows a bottom perspective and FIG. 6 shows a top perspective of multi-chamber ink tank 262. Five outlet ports 272 (each corresponding to an ink source) extend from a bottom surface of a tank body 270 of multi-chamber ink tank 262. Each outlet port 272 has an outlet opening 273, which is oval-shaped in the example of FIG. 5. A raised rim 269 surrounds each outlet opening 273 and the raised rim 269 includes a sealing face 271. A wick 274 is disposed at each outlet opening 273 for transferring of ink to the corresponding inlet port of printhead 250. Wick 274 is a porous member that can be made of a fibrous material (such as a felted material) or a sintered material (such as a sintered plastic) in various embodiments. A latching lever 276 extends outwardly from a back wall 275 of multi-chamber ink tank 262. Latching lever 276 includes a latch 278 that engages with catch 261 (FIG. 2) on printhead 250 when multi-chamber ink tank 262 is mounted onto printhead 250. A guide feature 279 is provided on a wall opposite back wall 275 for guiding multi-chamber ink tank 262 into proper position on printhead 250.

Figure 7:
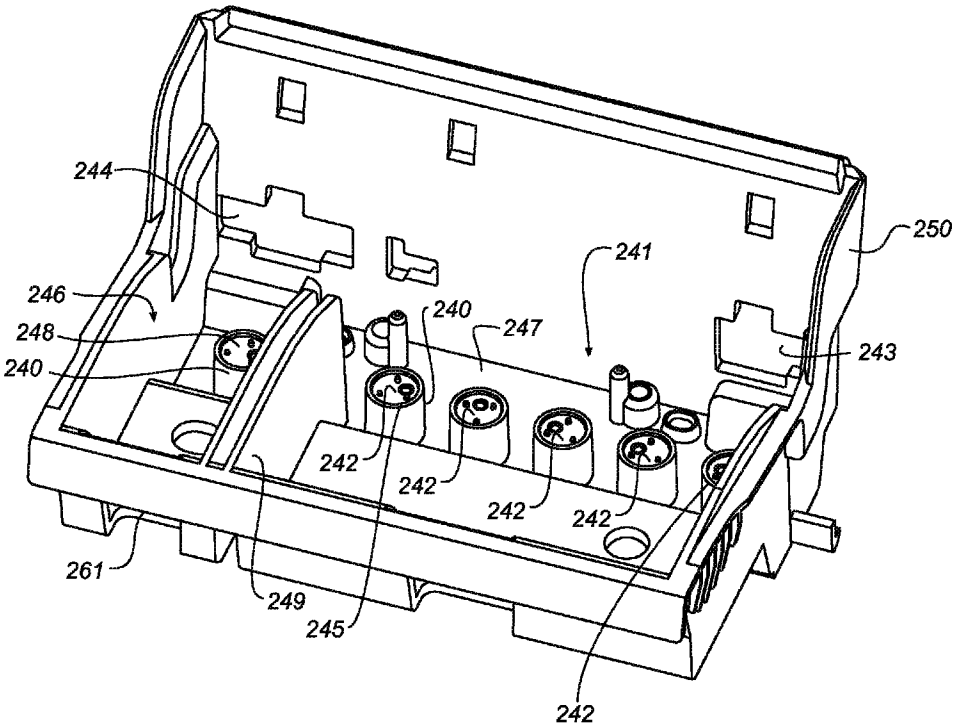
FIG. 7 is a perspective of a printhead without ink tanks mounted.

FIG. 7 shows a perspective of printhead 250 without either replaceable ink tank 262 or 264 mounted onto it. Multi-chamber ink tank 262 is mountable in a region 241 and single-chamber ink tank 264 is mountable in region 246 of printhead 250. Region 241 is separated from region 246 by partitioning wall 249, which can also help guide the ink tanks during installation. Guide feature 279 of multi-chamber ink tank 262 is inserted into hole 243 of printhead 250 during mounting of the multi-chamber ink tank 262. A similar guide feature (not shown) on single-chamber ink tank 264 is inserted into hole 244 of printhead 250 during mounting of the single-chamber ink tank 264. Five inlet ports 242 are shown in region 241 that connect with ink outlet ports 272 of multi-chamber ink tank 262 when it is installed onto printhead 250, and one inlet port 248 is shown in region 246 for the ink tank port on the single-chamber ink tank 264. In the example of FIG. 7 each inlet port 242 or 248 has the form of a standpipe 240 that extends from the floor of printhead 250. Typically a filter (such as woven or mesh wire filter, not shown) covers the end 245 of the standpipe 240. The diameter of end 245 of standpipe 240 is smaller than that of the outlet openings 273 of ink tank 262 or 264, so that the end 245 of each standpipe 240 is pressed into contact with a corresponding wick 274. When an ink tank is installed onto the printhead 250, it is in fluid communication with the printhead 250 because of the connection of the wicks 274 at outlet ports 272 with the ends 245 of standpipes 240 of inlet ports 242 or 248. Not shown in FIG. 7 is a gasket that is located on floor 247 and surrounds each of the standpipes 240. When an ink tank is installed onto the printer chassis 300, sealing face 271 (FIG. 5) of each outlet port 272 seals against the gasket on floor 247 to inhibit ink from leaking out and air from leaking into the ink passageways.

Figure 8:
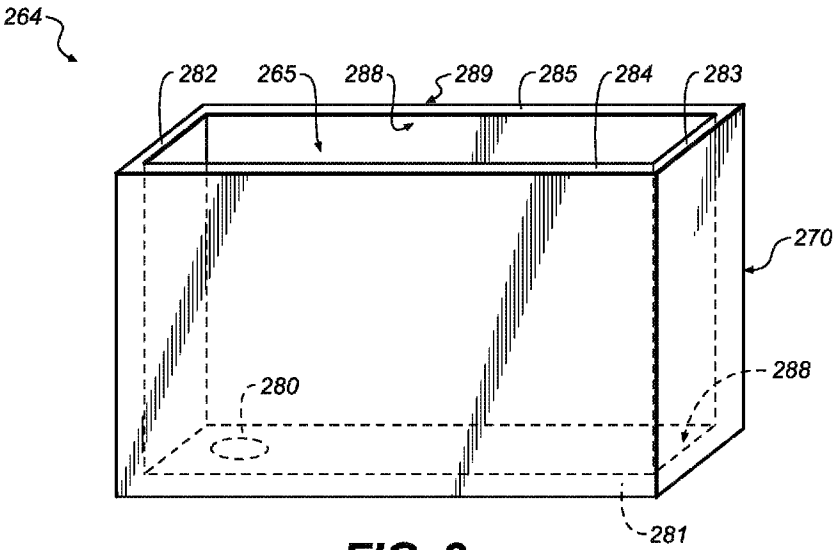
FIG. 8 is a perspective of an ink tank and its ink reservoir.

FIG. 8 is a perspective of a portion of a single-chamber ink tank 264 including a tank body 270 having a first wall 281, a second wall 282 intersecting a first end of the first wall 281, a third wall 283 intersecting a second end of the first wall 281, a first side wall 284 intersecting first wall 281 and extending from second wall 282 to third wall 283, and a second side wall 284 also intersecting first wall 281 and extending from second wall 282 to third wall 283. First wall 281 includes an ink outlet 280 configured to supply ink to a printhead 250 (FIG. 2). First wall 281, second wall 282, third wall 283, first side wall 284 and second side wall 285 have interior surfaces 288 that bound an ink reservoir 265 in single-chamber ink tank 264, as well as exterior surfaces 289 that form an outside of the single-chamber ink tank 264. A pressure regulator, such as a capillary member (not shown), can be included within single-chamber ink tank 264. A lid (not shown) would typically be affixed to the open side (opposite first wall 281). A latch for latching single-chamber ink tank 264 onto a printhead 250 is also not shown in FIG. 8.

Figure 9:
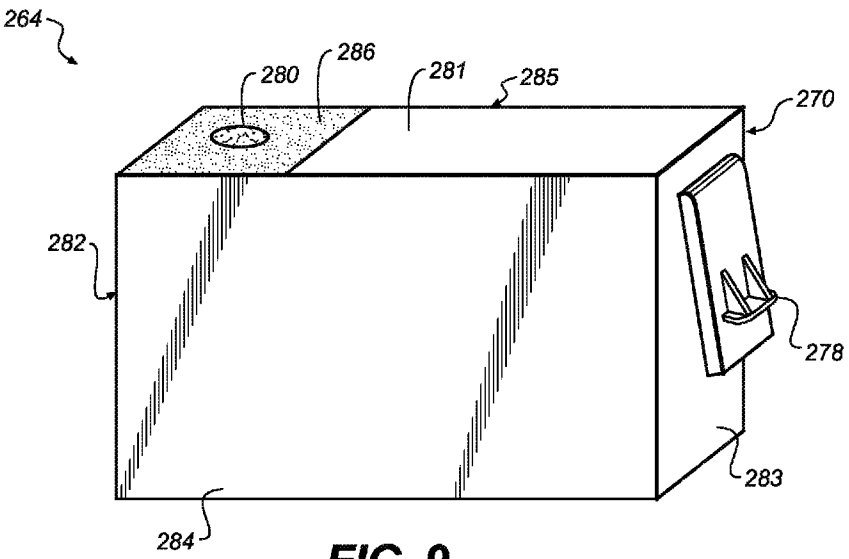
FIG. 9 is a perspective of an ink tank including an ink outlet.

FIG. 9 is a perspective of a single-chamber ink tank 264 similar to FIG. 8, but rotated so that first wall 281 is pointing upward. Unlike outlet port 272 of FIG. 5, ink outlet 280 does not have a raised rim that extends outwardly from first wall 281. A sealing area 286 surrounds ink outlet 280. A latch 278 extends from third wall 283.

Figure 10:
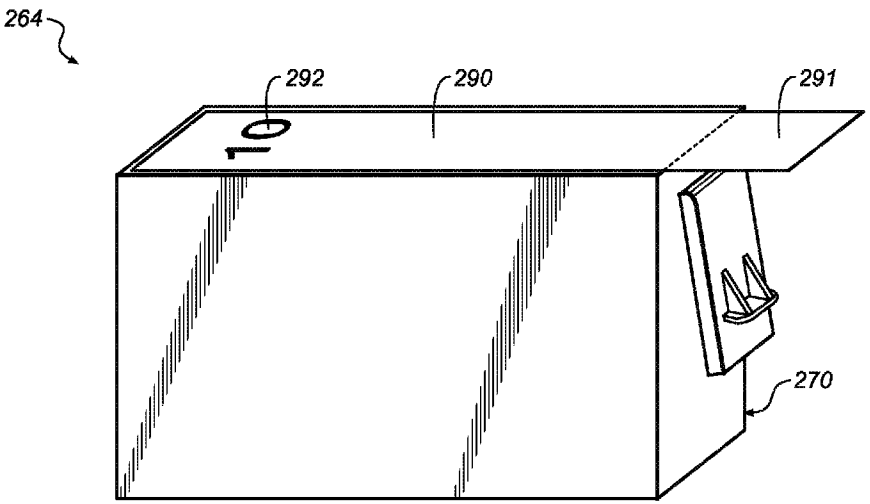
FIG. 10 (PRIOR ART)
FIG. 10 is a perspective of an ink tank with a sealing film adhered to a sealing area around the ink outlet.

FIG. 10 is a perspective similar to FIG. 9, but also including a sealing film 290 configured as in the prior art. An underside portion of sealing film 290 is sealed to sealing area 286 (FIG. 9). A visible side of sealing film 290 (opposite the underside) can include a label 292 indicating a type of ink tank, a manufacturer's brand, and other such information. Sealing film 290 also can include a pull tab 291 for the user to grasp when the sealing film 290 is removed before the single-chamber ink tank 264 is installed into a printhead 250.

Figure 11:
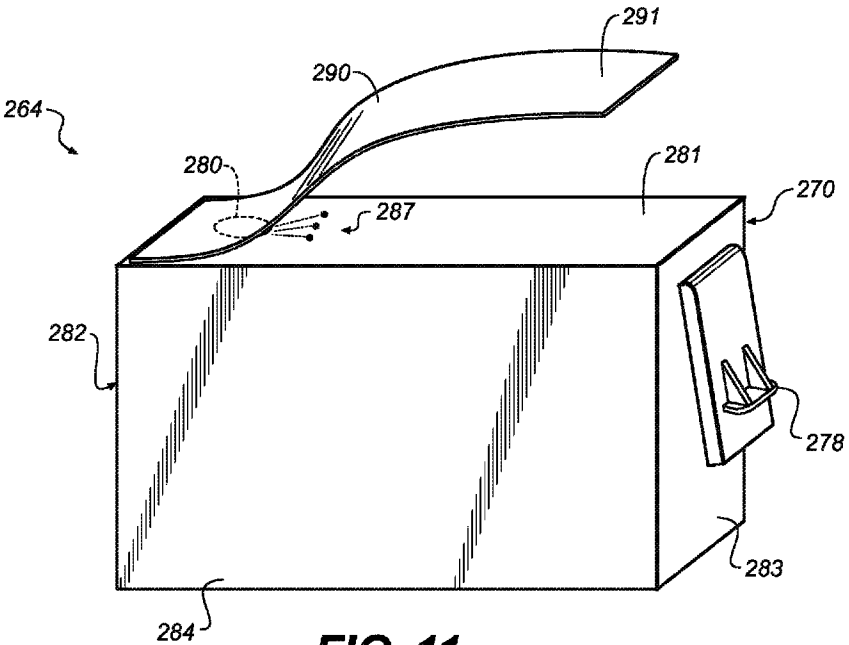
FIG. 11 (PRIOR ART)
FIG. 11 is a perspective of a prior art ink tank as the sealing film is removed.

FIG. 11 is a perspective of a prior art sealing film 290 in the process of being removed from single-chamber ink tank 264. As pull tab 291 of sealing film 290 is pulled in a direction from third wall 283 toward second wall 282, when the seal is broken surrounding ink outlet 280, a sticking of the sealing film 290 and then sudden release as it is pulled off can cause ink on the sealing film 290 to be flung off. The ink spatter droplets 287 can land on the user's fingers, his clothing, the tank body 270, or other inconvenient locations.

Figure 12:
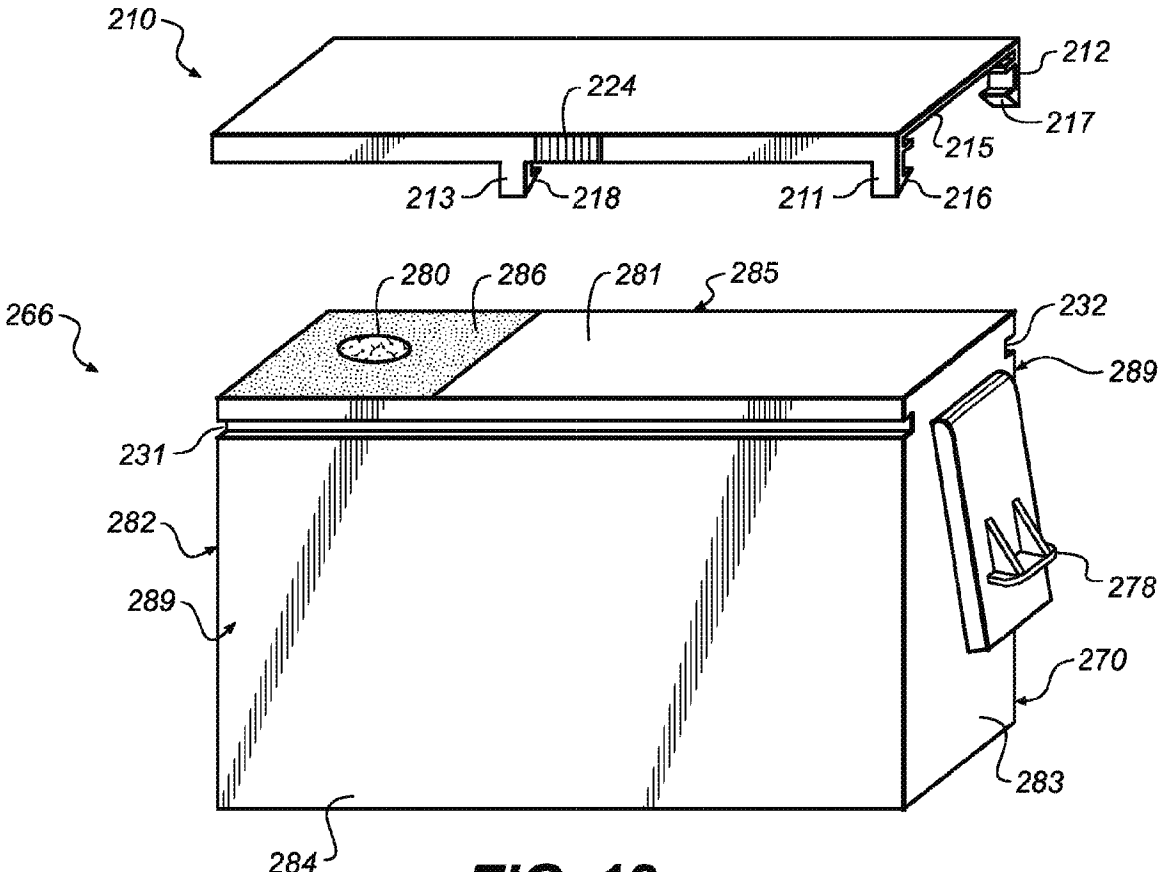
FIG. 12 is a perspective of an ink tank having a seal pulling member according to an embodiment of the invention.
Figure 13:
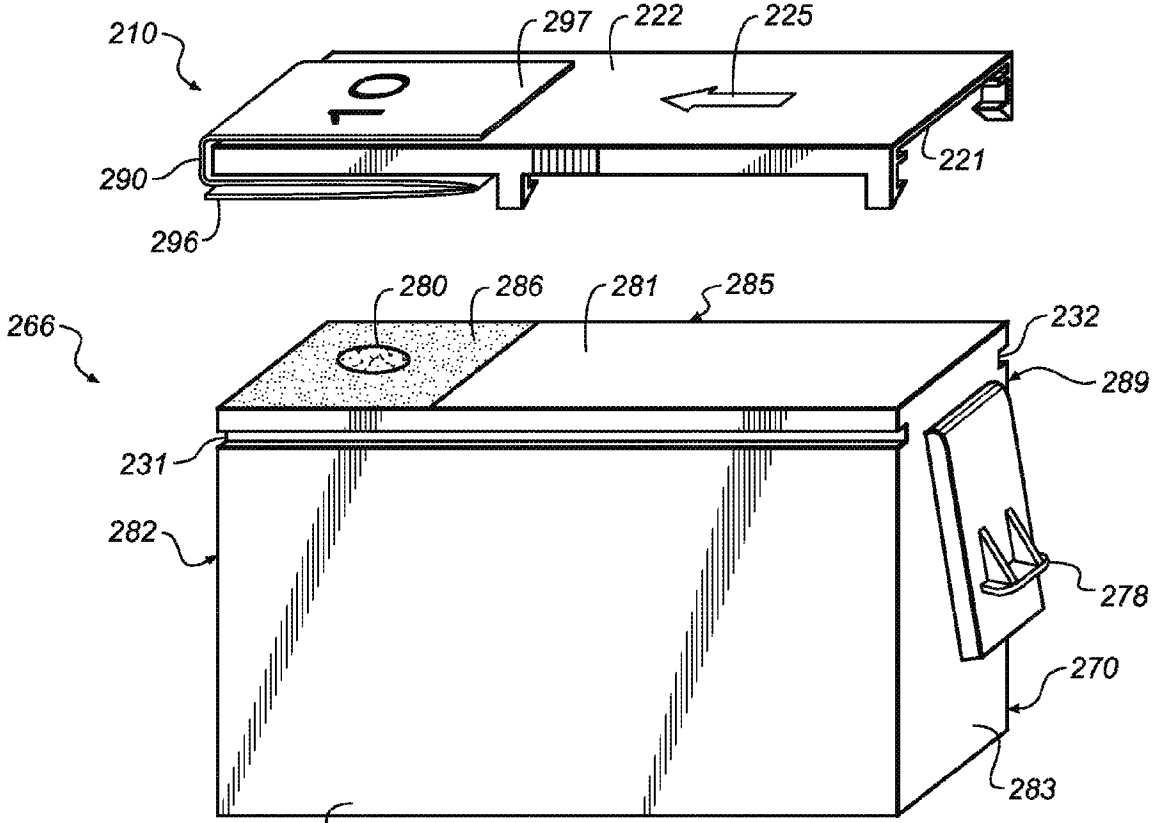
FIG. 13 is similar to FIG. 12, but also shows the sealing film.

FIGS. 12-13 are perspectives of an ink tank 266 having a seal pulling member 210 according to an embodiment of the present invention. Ink tank 266 has a similar overall structure as described above relative to FIGS. 8 and 9. In addition, first side wall 284 includes a first slider guide 231 formed in its exterior surface 289. Similarly, second side wall 285 includes a second slider guide 232 formed in its exterior surface 289. First slider guide 231 and second slider guide 232 are each located near first wall 281. In the embodiment shown in FIG. 12, first slider guide 231 is formed as a groove in exterior surface 289 of first side wall 284 and second slider guide 232 is formed as a groove in exterior surface 289 of second side wall 285. First slider guide 231 and second slider guide 232 are typically parallel or substantially parallel to first wall 281. In other embodiments (not shown), first slider guide 231 and second slider guide 232 can be formed as ridges on exterior surfaces 289 of side walls 284 and 285. Although not shown in FIG. 12, a sealing film 290 (see FIG. 13) is adhered to sealing area 286 surrounding ink outlet 280. Sealing film 290 is not shown in FIG. 12, so that by comparing FIGS. 12 and 13 the various parts can be more clearly distinguished.

Figure 14:
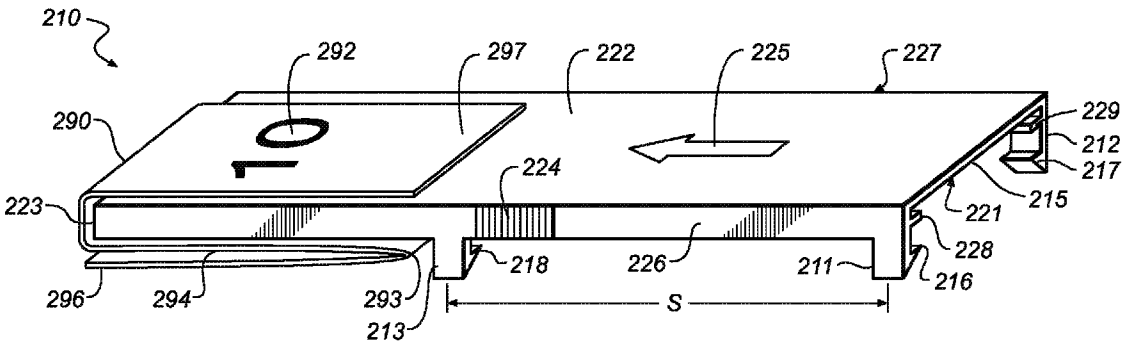
FIG. 14 is an enlarged perspective of the seal pulling member of FIG. 13.

Also shown in FIGS. 12 and 13, as well as the enlarged perspective of FIG. 14, is seal pulling member 210, which is used to remove sealing film 290 from sealing area 286 in a controllable fashion. Seal pulling member 210 includes a base 215 that is located near first wall 281 when seal pulling member 210 is mounted on ink tank 266. First leg 211 extends from base 215 and includes a first foot 216 that is slidably engageable with first slider guide 231. Opposite first leg 211 is second leg 212 that similarly includes a second foot 217 that is slidably engageable with the second slider guide 232. Seal pulling member 210 can also include a third leg 213 having a third foot 218 that is slidably engageable with first slider guide 231, and a fourth leg (not visible in FIGS. 13-14) having a fourth foot (not visible in FIGS. 13-14) that is slidably engageable with second slider guide 232. Third foot 218 is separated from first foot 216 by a separation S (see FIG. 14).

Sealing film 290 is affixed to seal pulling member 210 and also to first wall 281 of ink tank 266. In particular, sealing film 290 is adhered to sealing area 286 near a first end 296 of sealing film 290. Sealing film 290 is shown out of contact with sealing area 286 in the exploded views of FIGS. 13 and 14 so that various parts can be seen more clearly, but it is to be understood that an underside of sealing film 290 near first end 296 is adhered to sealing area 286. Sealing film 290 is affixed to seal pulling member 210 near a second end 297 of sealing film 290. Sealing film 290 can be affixed to seal pulling member 210 by an adhesive, by a thermal weld, by an ultrasonic weld, or by a mechanical clamp (not shown) for example.

In the example shown in FIGS. 13 and 14, sealing film 290 includes a fold 293 between first end 296 and second end 297. Seal pulling member 210 includes a first surface 221 near first wall 281 of ink tank 266, and a second surface 222 opposite first surface 221. In the example shown in FIGS. 13 and 14, sealing film 290 is affixed to second surface 222 and wraps around an edge 223 of seal pulling member 210, such that a portion 294 of sealing film 290 between first end 296 and second end 297 is located near first surface 221 of seal pulling member 210. Fold 293 is located between sealing area 286 and the portion 294 of sealing film 290 that is near first surface 221 of seal pulling member 210. In other examples (not shown), sealing film 290 can be affixed to the first surface 221 of seal pulling member 210. In any case, an intent of the seal pulling member 210 and the configuration of sealing film 290 are that as seal pulling member 210 is slid along the direction indicated by marking 225, sealing film 290 undergoes a 180 degree peeling angle, which generates a large amount of force to peel sealing film 290 away from sealing area 286. This makes it both easier and more controllable for the user to remove sealing film 290. In addition, because base 215 of seal pulling member 210 continues to cover ink outlet 280 as seal pulling member 210 is slid along the direction indicated by marking 225, ink spatter drops 287 (FIG. 11) tend to land on first surface 221 of seal pulling member 210 rather than getting on the user's hands or clothing.

A gripping surface 224 (FIG. 12) is provided on first side 226 and second side 227 of seal pulling member 210 in order to make it obvious how the user is to hold the seal pulling member 210 while removing sealing film 290, and also to further facilitate removal of sealing film 290. Marking 225, which can include an arrow as shown in FIGS. 13 and 14 indicates a sliding direction for the user to slide seal pulling member 210. Marking 225 can be provided on second surface 222 of seal pulling member 210 (as in FIGS. 13 and 14), or alternatively marking can be provided on sealing film 290, for example near label 292.

In some embodiments, as shown in FIG. 14, restraining ledges are provided within the seal pulling member 210 in order to hold sealing film 290 in position. In particular, seal pulling member 210 includes a first side 226 near first leg 211 and a second side 227 near second leg 212. A first projection 228 extends from first side 226 toward second side 227 and acts as a first restraining ledge. A second projection 229 extends from second side 227 toward first side 226 and acts as a second restraining ledge.

Figure 15:
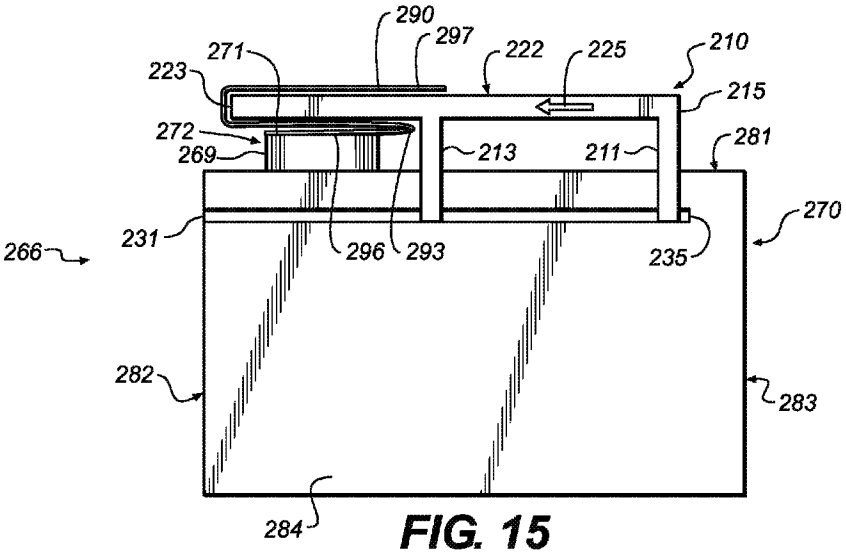
FIG. 15 is a side view of an ink tank according to an embodiment of the invention.

FIG. 15 is a side view of a portion of ink tank 266 in an embodiment where outlet port 272 includes a rim 269 extending outwardly from first wall 281 similar to the ink tank 262 of FIG. 5. First end 296 of sealing film 290 is adhered to a sealing area corresponding to sealing face 271. As in the example of FIG. 14, sealing film 290 includes a fold 293 and wraps around an edge 223 of base 215 of seal pulling member 210. Second end 297 of sealing film 290 is affixed to second surface 222 of seal pulling member 210. Like the example of FIG. 13, the first slider guide 231 extends all the way to second wall 282, so that as seal pulling member 210 is slid along the direction indicated by marking 225, seal pulling member 210 can be pulled off of tank body 270. Unlike the example of FIG. 13, first slider guide 231 does not extend all the way to third wall 283. For example, if first slider guide 231 is a groove in the exterior surface of first side wall 284, the groove would terminate at closed end 235. As a result, the feet on legs 211 and 213 that engage with first slider guide 231 as well as the feet on legs on the opposite side that engage with second slider guide 232 (not shown) would interfere with closed end 235 if the user attempts to slide seal pulling member 210 in a direction opposite that indicated by marking 225.

Figure 16:
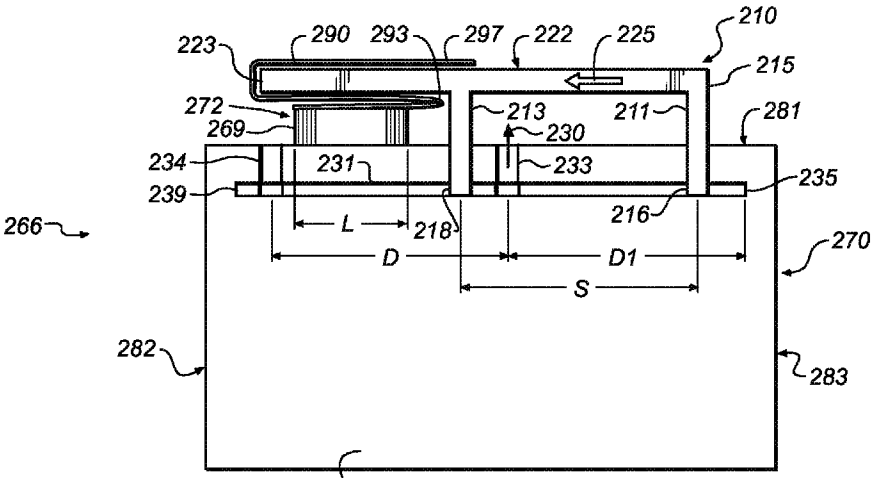
FIG. 16 is a side view of an ink tank similar to that of FIG. 15 but including a stop along the slider guide.

FIG. 16 is a side view of an ink tank similar to FIG. 15, but configured such that the seal pulling member 210 is not intended to be removed by sliding the feet all the way to second wall 282. Instead first slider guide 231 includes a stop 239 configured to restrict sliding motion of seal pulling member 210. In configurations where first slider guide 231 is a groove, stop 239 can be a termination of the groove, similar to closed end 235 described above. In order to permit removal of seal pulling member 210, recesses such as first recess 233 and third recess 234 are provided in first side wall 284 along a recess direction 230 from the first wall 281 to the first slider guide 231. Similarly (not shown) a second recess and a fourth recess are provided in second side wall 285 along the recess direction from the first wall 281 to the second slider guide 232 (FIG. 12). First recess 233 is located at a first distance D from third recess 234. Second recess is located at a second distance from fourth recess. In some configurations, the second distance is equal to first distance D. Separation S between third foot 218 and first foot 216 is equal or substantially equal to first distance D, such that seal pulling member 210 is disengageable from tank body 270 along recess direction 230. Similarly a separation between the fourth foot and the second foot is equal or substantially equal to the second distance. Such a configuration of grooves and recesses can guide the user to remove the seal in a more controllable fashion. Rather than pulling off the sealing film 290 too rapidly and causing ink spatter droplets 287 (FIG. 11) to land in undesirable places, seal pulling motion is momentarily stopped when third foot 218 reaches stop 239, making sure that any ink spatter residue lands on seal pulling member 210, which is then lifted off in the recess direction 230.

In order to provide a long enough sliding distance for seal pulling member 210 along first slider guide 231 that the sealing film 290 can be completely removed, a distance D1 between closed end 235 and first recess 233 is greater than a length L of the sealing area where the sealing film 290 is adhered. In order that third foot 218 does not accidentally get pulled into first recess 233 during removal of sealing film 290, distance D1 is less than the separation S between the first foot 216 and the third foot 218.

Figure 17:
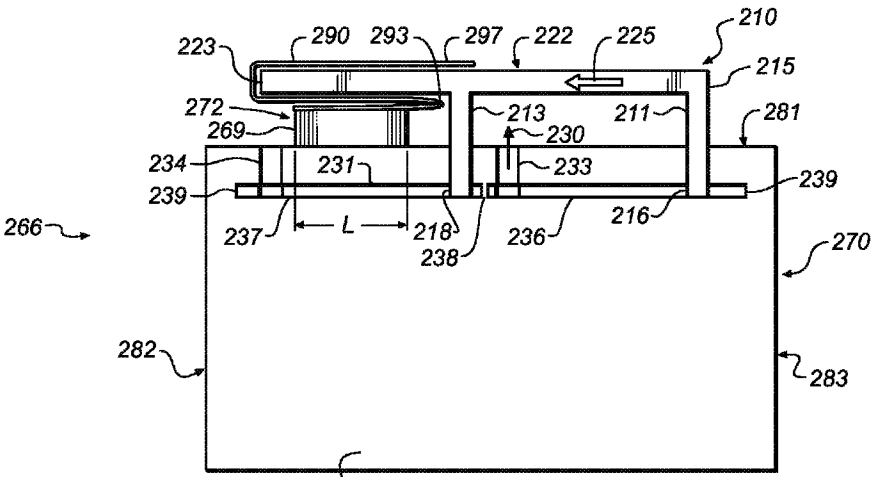
FIG. 17 is a side view of an ink tank similar to that of FIG. 16 where the slider guide is not continuous.

First slider guide 231 does not need to be a continuous guide (i.e. a continuous groove). FIG. 17 shows a side view of a configuration where first slider guide 231 includes a first grooved portion 236, a second grooved portion 237 and a non-grooved portion 238 located between first grooved portion 236 and second grooved portion 237.

Figure 18:
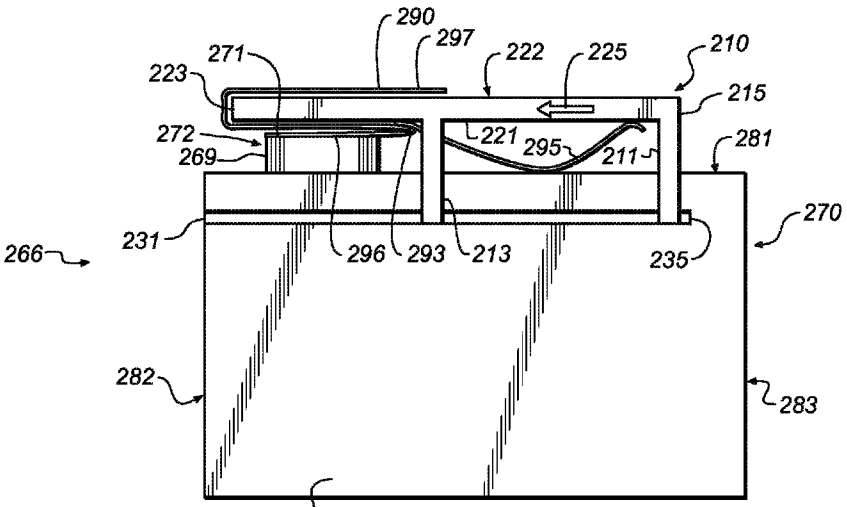
FIG. 18 is a side view of an ink tank similar to that of FIG. 15 but also including a second film.

In some embodiments a second film 295 is attached to sealing film 290, as shown in the side view of FIG. 18. Second film 295 is adhered to sealing film 290 near fold 293, and also is optionally adhered to first surface 221 of seal pulling member 210. As seal pulling member 210 is slid along first slider guide 231 in the direction indicated by marking 225, second film 295 is pulled along behind sealing film 290 and helps to capture ink spatter residue as sealing film 290 is removed from sealing area, such as sealing face 271.

The invention has been described in detail with particular reference to certain preferred embodiments thereof, but it will be understood that variations and modifications can be effected within the spirit and scope of the invention.

PARTS LIST d density
D Distance
D1 Distance
S Separation
L Length
10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
210 Seal pulling member
211 First leg
212 Second leg
213 Third leg
215 Base
216 First foot

PARTS LIST (CON'T)

217 Second foot
218 Third foot
221 First surface
222 Second surface
223 Edge
224 Gripping surface
225 Marking
226 First side
227 Second side
228 First projection
229 Second projection
230 Recess direction
231 First slider guide
232 Second slider guide
233 First recess
234 Third recess
235 Closed end
236 First grooved portion
237 Second grooved portion
238 Non grooved portion
239 Stop
240 Standpipe
241 Region (for mounting multi-chamber ink reservoir)
242 Inlet port
243 Hole
244 Hole
245 End
246 Region (for mounting single-chamber ink reservoir)
247 Floor
248 Inlet port
249 Partitioning wall

PARTS LIST (CON'T)

250 Printhead
251 Printhead die
253 Nozzle array
254 Nozzle array direction
256 Encapsulant
257 Flex circuit
258 Connector board
261 Catch for ink tank latching mechanism
262 Multi-chamber ink tank
264 Single-chamber ink tank
265 Ink reservoir
266 Ink tank
269 Rim
270 Tank body
271 Sealing face
272 Outlet port
273 Outlet opening
274 Wick
275 Back wall
276 Latching lever
278 Latch
279 Guide feature

280 Ink outlet
281 First wall
282 Second wall
283 Third wall
284 First side wall
285 Second side wall
286 Sealing area
287 Ink spatter droplets
288 Interior surface

PARTS LIST (CON'T)

289 Exterior surface
290 Sealing film
291 Pull tab
292 Label
293 Fold
294 Portion (between first end and second end)
295 Second film
296 First end
297 Second end
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media
371 Top piece of medium
380 Carriage motor

PARTS LIST (CON'T)

382 Carriage guide rail
383 Encoder fence
384 Belt
390 Printer electronics board
392 Cable connectors

The invention claimed is:

1. An ink tank that is mountable to a printhead, the ink tank comprising:
- a tank body including
  - a first wall including an ink outlet configured to supply ink to the printhead;
  - a first side wall intersecting the first wall;
  - a second side wall opposite the first side wall;
  - a first slider guide disposed on the first side wall and including a first groove;
  - a second slider guide disposed on the second side wall and including a second groove;
  - wherein the first and second slider guides are proximate the first wall;
  - an ink reservoir including interior surfaces of the tank body; and
- a film that is adhered to a sealing area surrounding the ink outlet;
- a seal pulling member including:
  - a base disposed proximate the first wall;
  - a first leg extending from the base, the first leg including a first foot that is slidably engageable with the first slider guide; and
  - a second leg extending from the base, the second leg including a second foot that is slidably engageable with the second slider guide, wherein the film is affixed to the seal pulling member;
- wherein the first wall further includes a first recess extending along a recess direction from the first wall to the first groove, and the second side wall further includes a second recess extending along the recess direction from the first wall to the second groove.

2. The ink tank of claim 1, the film including a first end and a second end, the film adhered to the sealing area proximate the first end, and the film affixed to the seal pulling member proximate the second end.

3. The ink tank of claim 1, wherein the film includes a fold between the first end and the second end.

4. The ink tank of claim 3, the seal pulling member including a first surface proximate the first wall of the ink tank, and a second surface opposite the first surface, wherein the film is affixed to the first surface of the seal pulling member.

5. The ink tank of claim 3, the seal pulling member including a first surface proximate the first wall of the ink tank, and a second surface opposite the first surface, wherein the film is affixed to the second surface of the seal pulling member.

6. The ink tank of claim 5, wherein the film is a first film and further includes a second film affixed to the first surface of the seal pulling member.

7. The ink tank of claim 5, wherein the film wraps around an edge of the seal pulling member such that a portion of the film between the first end and the second end is disposed proximate the first surface of the seal pulling member.

8. The ink tank of claim 7, wherein the fold is disposed between the sealing area and the portion of the film disposed proximate the first surface of the seal pulling member.

9. The ink tank of claim 1, the first side wall further including a third recess disposed at a first distance from the first recess, and the second side wall further including a fourth recess disposed at a second distance from the second recess.

10. The ink tank of claim 1, the seal pulling member further including:
- a third leg including a third foot that is slidably engageable with the first groove; and
- a fourth leg including a fourth foot that is slidably engageable with the second groove.

11. The ink tank of claim 10, a separation between the third foot and the first foot substantially equal to the first distance, and a separation between the fourth foot and the second foot substantially equal to the second distance, such that the seal pulling member is disengageable from the tank body along the recess direction.

12. The ink tank of claim 10, the first groove including a closed end, wherein a distance between the closed end and the first recess is greater than a length of the sealing area.

13. The ink tank of claim 12, wherein a distance between the closed end and the first recess is less than the separation between the first foot and the third foot.

14. The ink tank of claim 1, the seal pulling member including a gripping surface.

15. The ink tank of claim 1, the seal pulling member including a marking to indicate a sliding direction.

16. The ink tank of claim 1, the film including a marking to indicate a sliding direction for the seal pulling member.

17. The ink tank of claim 1, wherein the first groove includes:

a first grooved portion;

a second grooved portion; and a non-grooved portion between the first section and the second section.

18. The ink tank of claim 1 further including a stop configured to restrict a sliding motion of the seal pulling member along the first groove.

19. The ink tank of claim 1, the seal pulling member further including:

a first side proximate the first leg;

a second side proximate the second leg;

a first projection extending from the first side toward the second side; and a second projection extending from the second side toward the first side.

20. The ink tank of claim 1, wherein the first slider guide and the second slider guide are substantially parallel to the first wall.

21. An ink tank that is mountable to a printhead, the ink tank comprising:

a first wall having an ink outlet configured to supply ink to the printhead;

a slider guide disposed on an exterior surface of the ink tank and extending along a direction that is parallel or substantially parallel to the first wall;

a film that is adhered to a sealing area surrounding the ink outlet, the sealing area having a length L; and a seal pulling member for removing the film from the sealing area, the seal pulling member configured to slide along the slider guide parallel or substantially parallel to the first wall.

* * * * *